United States Patent [19]

Barone

[11] Patent Number: 4,540,605

[45] Date of Patent: Sep. 10, 1985

[54] METHODS FOR COATING ACOUSTICAL SURFACES

[76] Inventor: John A. Barone, 34 Winston Dr., Brentwood, N.Y. 11717

[21] Appl. No.: 614,864

[22] Filed: May 29, 1984

[51] Int. Cl.[3] ..... B05D 5/00; B05D 7/24

[52] U.S. Cl. ..... 427/243; 427/299; 427/322; 427/324; 427/384; 427/396; 427/421

[58] Field of Search ..... 181/291; 427/243, 140, 427/299, 324, 384, 396, 322, 421

[56] References Cited

U.S. PATENT DOCUMENTS

| | | | |
|---|---|---|---|
| 3,223,547 | 12/1965 | Bindler | 106/316 |
| 3,711,554 | 1/1973 | Engelhardt et al. | 524/335 |
| 3,904,533 | 9/1975 | Neiditch et al. | 252/8.8 |
| 3,929,705 | 12/1975 | Minieri | 424/273 X |
| 4,018,611 | 4/1977 | Cramer et al. | 106/15 R |
| 4,116,628 | 9/1978 | Hesse et al. | 427/154 |
| 4,135,945 | 1/1979 | Buono et al. | 106/308 N |
| 4,167,420 | 9/1979 | Linden et al. | 106/288 B |
| 4,167,421 | 9/1979 | Linden et al. | 106/288 B |
| 4,205,997 | 6/1980 | Hesse et al. | 106/308 Q |
| 4,219,365 | 8/1980 | Dietz et al. | 106/308 Q |
| 4,330,341 | 5/1982 | May et al. | 106/308 N |

FOREIGN PATENT DOCUMENTS

| | | |
|---|---|---|
| 10887 | 3/1981 | Japan . |
| 70817 | 5/1982 | Japan . |
| 181020 | 11/1982 | Japan . |

*Primary Examiner*—Evan K. Lawrence

*Attorney, Agent, or Firm*—Lowe, King, Price & Becker

[57] ABSTRACT

Methods for coating acoustical surfaces without substantially clogging the pores and reducing the sound absorption characteristics. The compositions applied to the surfaces of the acoustical materials in the coating method comprise an aqueous mixture containing a disinfectant, a pigment such as titanium dioxide, a quaternary ammonium compound of the following formula

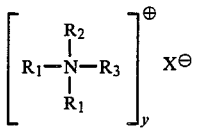

wherein $R_1$ is an aliphatic hydrocarbon containing from 16 to 20 carbon atoms, $R_2$ is an alkyl group containing from 1 to 3 carbon atoms, and $R_3$ is selected from the group consisting of $R_1$ and $R_2$, and an air freshener.

7 Claims, No Drawings

METHODS FOR COATING ACOUSTICAL SURFACES

FIELD OF THE INVENTION

This invention relates to methods for coating porous acoustical surfaces with liquid coating compositions without adversely affecting the acoustical qualities.

BACKGROUND OF THE INVENTION

Acoustical surfaces are used in those areas where sound absorbing qualities are necessary. A common area where such materials are found is in buildings wherein acoustic tile is commonly used to cover the ceiling. These tiles are often white or near-white in color. Acoustic tiles of this type are generally composed of porous layers of mineral or vegetable fibers bonded together with non-thermoplastic resins. The tiles may also be composed of glass fibers. The acoustic tiles of this type are provided with substantial porosity in order to absorb sound waves which emanate within the room. This porosity is evidenced on the surface of the acoustic tiles by the presence of small recesses or pores of varying diameter which permit the sound waves to enter the material and be dispersed.

Because the tiles are white, they become discolored as dirt and grease deposits accumulate on them. Further, becasue of the porosity of the fiber layers making up the tiles, they are difficult to clean. Detergents have been used to try and clean the tiles, but detergents may dissolve the dirt to the point where it becomes liquid and is trapped in the pores of the fiber layer. On cleaning by wiping, streaking may occur.

Since the porous tiles are so difficult to clean, a second option is to cover the tile surface with paint. Conventional paint has many disadvantages, however, primarily because the paint clogs the pores of the fiber layer, thereby reducing the sound buffering properties of the tile. Further, paint tends to make the tile hard and brittle, rendering it more susceptible to damage if struck. Therefore, because of the difficulties of cleaning the tile, and the disadvantages of painting it, the most common form of maintenance is simply replacement. However, this is obviously expensive.

The present invention provides a method utilizing a coating compsition which can be applied to acoustic surfaces with excellent results. Similar coating compositions are known in the prior art but are known for use in different areas. Thus, in U.S. Pat. No. 4,135,945, there is disclosed an aqueous pigment dispersion which contains a pigment component, such as titanium dioxide, a surfactant, water, and a biocide. U.S. Pat. Nos. 4,167,420 and 4,167,421 disclose paint dispersions which contain titanium dioxide pigment, together with quaternary ammonium dispersing agents. U.S. Pat. No. 3,929,705 discloses surface coating compositions which are aqueous solutions of water, biocides, surfactants, and titanium dioxide pigment.

SUMMARY OF THE INVENTION

It is, accordingly, an object of the invention to provide methods for application of a novel coating composition to porous acoustical surfaces, such as ceiling tiles, which coating does not substantially clog the pores and reduce the sound absorption characteristics of the acoustical surfaces.

Other objects and advantages of the present invention will become apparent as the description thereof proceeds.

In satisfaction of the foregoing objects and advantages, there is provided by the present invention a novel method for coating an acoustical surface which contains pores adapted tp receive sound waves without substantially clogging the pores and reducing the sound adsorption characteristics, which comprises applying to the surface of the acoustical material a coating composition comprising about 1.0 to 200 parts by volume of a pigment, about 0.08 to 0.8 parts by volume of a disinfectant, about 0.1 to 1.0 parts by volume of an air freshener, about 0.1 to 1.0 parts by volume of a quaternary ammonium compound of the following formula:

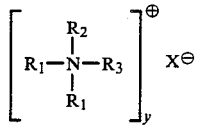

wherein $R_1$ is aliphatic hydrocarbon containing from 16 to 20 carbon atoms, $R_2$ is an alkyl group containing from 1 to 3 carbon atoms, and $R_3$ is selected from the group consisting of $R_1$ and $R_2$, X is an anion and y is the valency of X, these components being contained in about 50 to 200 parts by weight of water, and permitting the coating to dry.

Preferably, the composition is sprayed onto the acoustical surface to obtain a uniform distribution of composition on the tile. Prior to spraying, the surface should preferably be vacuumed and bleached and washed to improve brightness.

DESCRIPTION OF PREFERRED EMBODIMENTS

As indicated above, the present invention is concerned with an aqueous mixture which is useful as a covering composition for the surfaces of acoustical materials which contain fibrous layers. It has been found that this coating composition can be applied to the surface of an acoustical material, such as an acoustic tile, in order that the surface will be covered with a coating which will not clog the pores required for the surface to retain its acoustical characteristics. Therefore, the coating composition provides a method for the cleaning or coating of acoustical materials, such as ceiling tiles, which is effective to provide a new surface to the tile without decreasing the sound-absorbing characteristics of the acoustical material and without clogging the pores, which are necessary for the material to retain its acoustical characteristics.

The composition of the present invention is an aqueous formulation in the form of a slurry. In general, the formulation contains a pigment, a disinfectant or biocide, a quaternary ammonium compound which has the characteristics of a surfactant, an air freshener and water. Optionally, the composition may also contain other materials, such as coloring agents. The preferred composition comprises about 0.08 to 0.8 parts by volume of disinfectant or biocide, about 1.0 to 20.0 parts of the pigment, and about 50 to 200 parts by volume of water. If coloring agents and the like are contained in the mixture, they should be contained in amounts of about 0.1 to 1.0 parts by volume.

The most preferred composition of the present invention will contain about 0.1 to 1.0 parts by volume of the quaternary ammonium compound, about 0.08 to 0.8 parts by volume of the disinfectant components, about 1.0 to 20.0 parts by volume of pigment and 17.0–100.0 parts by volume of a binding agent composition, which is composed of 5.0–30.0 parts by volume of silicon compounds, 10.0–50.0 parts of ester compounds, and 2.0–20 parts naptha, as well as trace amounts of other ingredients, all of which is contained in about 50 to 200 parts by volume of water.

The pigment component of the composition is any pigment which provides a suitable coloring to the composition, but is preferably titanium dioxide, which is white in color and appears to interact with the other components of the composition to provide a surface coating which dries to cover and become integral with the surface of acoustical surfaces without clogging the pores contained therein by entering and becoming absorbed by the fiber surface. The pigment such as titanium dioxide is a solid but can be obtained commercially as an aqueous slurry such as in a conventional latex paint. Such paints normally contain the pigments in amounts of about 5 to 12 weight percent. A preferred pigment composition contains about 6.0 volume percent of titanium dioxide, 12.0 volume percent silicon compounds. 18.0 percent ester compounds, and 7.5 volume percent naptha in 56.3 volume percent of water. This is the preferred composition for use in the present invention, and the remaining components of the composition are based on this starting composition in the commercial aspect.

The disinfectant or biocide used in the composition of the present invention can, in general, be any of the known biocides or disinfectants which are used in coating compositions, such as paints. Suitable disinfectants or biocides include, for example, diiodomethyl sulfones, as disclosed in U.S. Pat. Nos. 3,615,745, 3,663,623 and 4,018,611. Also, there may be used the antimicrobic materials comprising the acetanilides, as disclosed in U.S. Pat. No. 3,223,547, as well as the oxazolidine biocides disclosed in U.S. Pat. No. 4,135,945. The preferred biocides, however, are quaternary ammonium halide compositions which are sold commercially as disinfectants for acoustical tiles. One such commercial product is solid under the trade name "Wintergreen II". This commercially available composition contains 4.5 weight percent of active ingredients and 95.5 percent of an inert ingredient. The active ingredients include a quaternary ammonium compound, such as dimethyl benzyl ammonium chloride, a small amount of an alcohol, such as isopropanol, 2 percent for example, and a small amount, such as 0.5 percent, of methyl salicylate, which provides the Wintergreen fragrance to the composition.

The quaternary ammonium compound, when used in combination with the other components, provides the composition with the flow characteristics which enable it to coat the acoustical material without clogging the pores. These quaternary ammonium compounds are known compounds in the art, but are not for this purpose. They are known, for example, as fabric conditioners and are disclosed in U.S. Pat. No. 3,904,533, the disclosure of which is incorporated herein by reference. The quaternary ammonium compounds are available commercially as fabric conditioners under the trade name "Final Touch" and the Final Touch solution as purchased can be used and is preferred to be used in the formulation of this invention.

The quaternary ammonium component as defined in this invention is preferably a quaternary ammonium compound of the following general formula

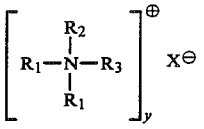

wherein $R_1$ is an aliphatic hydrocarbon containing from 16 to 20 carbon atoms, $R_2$ is an alkyl group containing from 1 to 3 carbon atoms, and $R_3$ is selected from the group consisting of $R_1$ and, $R_2$. In this formula, X is an anion which may be a halide or sulfate, and y is the valency of X.

These quaternary ammonium compounds are preferably used as an emulsion in water, together with stabilizers for the emulsion, as defined in U.S. Pat. No. 3,904,533. The amount of the active quaternary ammonium ingredient contained in this emulsion may range from 80 to 99.5 weight percent. There may also be contained within the emulsion an optical brightener in the amount of about 0.5 to 20 parts, and the stabilizer may be present in an amount of about 5 to 10 volume percent.

The remainder of the composition of this invention comprises water, and the resulting mixture is a slurry of the pigment in water, together with the other components. As with known compositions, of this type, the composition also includes 0.1 to 1.0 parts by volume of an air freshener of the conventional type. There also may be included additional coloring agents and the like. The preferred air freshener is available commercially under the name "Air Kleen."

A preferred method for preparation of these formulations includes initially forming a solution containing the quaternary ammonium composition, the disinfectant or biocide composition, water and air freshener. This mixture is then mixed with the pigment or titanium dioxide in water with binding agents containing the pigment which is obtained as described above. The preferred mixing ratio of the quaternary ammonium composition to the pigment composition in the range of 1:3 up to 1:5. A preferred formulation will comprise about one quart of the quaternary ammonium composition to about one gallon of the titanium dioxide composition. The mixture should then be vigorously mixed in vertical and horizontal motions for at least five minutes, after which the mixture should be strained through a filter, such as a 200 mesh silk or wire strain. This produces a preferred formulation designed to be sprayed onto the surface. A more concentrated formulation would be used for rolling or brushing on the surface, however, spraying is highly preferred to obtain optimal reconditioning or whitening of the surface.

After the formulation is prepared, it can be applied to the porous surface and permitted to dry. Application may be by spraying, or by the use of a roller or a paint brush in the conventional manner, as discussed above. The surface should be cleaned conventionally by vacuum prior to application of the coating. Bleaching and washing of the surface prior to application of the coating will improve brightness. After application of the formulation, it is permitted to dry to obtain the resulting covered surface.

The following examples are presented to illustrate the invention, but it is not to be considered as limited thereto. In the examples and throughout the specification. parts are by weight unless otherwise indicated.

EXAMPLE 1

A five gallon composition was prepared which contained 10 fluid ounces of the quaternary compound, eight ounces of the disinfectant, 10 ounces of air freshener and the balance distilled water. The quaternary compound was a product purchased commercially as "Final Touch", a fabric softener sold by Lever Brothers. The disinfectant was 10 ounces of the commercial product "Wintergreen II", which is a quaternary ammonium composition containing 2.0% of a biocidal quaternary compund and 0.5% methyl salicylate for wintergreen odor. The air freshener was the commercial product "Air Kleen" from Ebco. One quart of this mixture was combined with one gallon of a slurry containing 6.0 volume percent of titanium dioxide, and 56.0 volume percent of water, and the balance composed of binding agents, such that the binder composition contains 32.0% silicon compounds, 48% ester compounds and 20% naptha. The ingredients were mixed vigorously in horizontal and vertical motions and then strained through a 200 mesh silk mesh. The resulting composition is set forth in Table I.

TABLE I

| Ingredient | Fluid Ounces | Volume Percent |
|---|---|---|
| Quaternary Amm. Compound | 0.5 | .31 |
| Disinfectant | 0.4 | .25 |
| Air Freshener | 0.5 | .31 |
| Titanium dioxide | 8.0 | 5.00 |
| Silicon compounds | 15.4 | 9.63 |
| Ester compounds | 23.0 | 14.38 |
| Naptha | 9.6 | 6.00 |
| Water | 102.6 | 64.12 |
| Total | 160.0 | 100.00 |

This composition was then sprayed onto an acoustical tile surface. On drying, it was observed that the surface was white and brightened and the pores were not clogged.

The formulations of the present invention are nonflammable compositions with a Class A flame spread rating. On application to the porous surface of an acoustical tile, the drying time is about one hour by spray application, and the sound absorption will be diminished less than 5 percent from the original sound absorption of the acoustical material. The light-reflecting capacity will be improved by 50 percent, based on five year old panels that were subsequently sprayed with the composition for testing purposes.

The composition may be sprayed onto acoustical tiles from which it dries and adheres to the surface of the fiber layer of the tiles. It does not clog the pores. The dried composition will cover the dirt and, therefore, whiten the tile, but is does not leave the fiber structure dry or brittle or decrease its sound-absorbing properties.

EXAMPLE 2

The formulation of Example 1 of Table I was submitted for evaluation by analyses. The composition was found to have the following properties.

TABLE II

| | |
|---|---|
| Flash Point | Greater than 200° F. |
| Flammability | Greater than 200° F. |
| Viscosity | 268.07 seconds |
| Specific Gravity | 1.180 |
| Combustibility | Non-combustible |
| Reactivity | Non-reactive |
| Ignitability | Greater than 400° F. |
| Calcium | .010 |
| Chromium | 1.73 |
| Copper | .71 |
| Iron | 8.51 |
| Silver | .17 |
| Nickel | 1.66 |
| Lead | 2.71 |
| Mercury | 14.7 |
| Selenium | .1 |
| Arsenic | Less than .01 |

The invention has been described herein with reference to certain preferred embodiments. However, as obvious variations thereon will become apparent to those skilled in the art, the invention is not to be considered as limited thereto.

I claim:

1. A method for coating an acoustical surface which contains pores adapted to receive soundwaves, without substantially clogging the pores and reducing the sound absorption characteristics, which comprises applying to the surface of the acoustical material a coating composition comprising about 1.0 to 20.0 parts by volume of a pigment, about 0.08 to 0.8 parts by volume of a disinfectant, about 0.1 to 1.0 parts by volume of an air freshener, about 0.1 to 1.0 parts by volume of a quaternary ammonium compound of the following formula

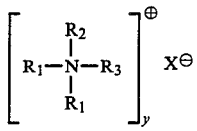

wherein $R_1$ is an aliphatic hydrocarbon containing from 16 to 20 carbon atoms, $R^2$ is an alkyl group containing from 1 to 3 carbon atoms, and $R_3$ is selected from the group consisting of $R_1$ and $R_2$, X is an anion and y is the valency of X, these components being contained in about 50 to 200 parts by weight of water, and permitting the coating to dry.

2. A method according to claim 1 wherein the pigment is titanium dioxide.

3. A method according to claim 1 wherein the disinfectant is a long-chain quaternary ammonium compound.

4. A method according to claim 1 wherein the composition also contains binding agents.

5. A method according to claim 1 which comprises applying the coating composition by spraying it onto the acoustical surface.

6. A method according to claim 5, wherein, prior to spraying, the surface is vacuumed, bleached and washed.

7. A method according to claim 5, wherein said coating composition is sprayed at an application flow rate in the approximate range of one gallon per minute at four hundred pounds of pressure.

* * * * *